US005616103A

United States Patent [19]

Lee

[11] Patent Number: 5,616,103

[45] Date of Patent: Apr. 1, 1997

[54] JOGGER EXERCISER

[76] Inventor: Kuo-Ron Lee, No. 61, Mei Chou Erh Road, Yi Lan City, Taiwan

[21] Appl. No.: 510,838

[22] Filed: Aug. 3, 1995

[51] Int. Cl.[6] ..... A63B 22/00

[52] U.S. Cl. ..... 482/51; 434/255

[58] Field of Search ..... 482/51, 70, 57, 482/52, 53, 54, 130, 74, 129, 79, 148; 434/255

[56] References Cited

U.S. PATENT DOCUMENTS

| | | | |
|---|---|---|---|
| 4,850,585 | 7/1989 | Dalebout | 272/70 |
| 4,861,023 | 8/1989 | Wedman | 482/51 |
| 4,940,233 | 7/1990 | Bull et al. | 482/52 |
| 5,000,443 | 3/1991 | Dalebout et al. | 482/70 |
| 5,299,993 | 4/1994 | Habing | 482/52 |
| 5,419,747 | 5/1995 | Piaget et al. | 482/51 |

*Primary Examiner*—Stephen R. Crow
*Attorney, Agent, or Firm*—Bacon & Thomas

[57] ABSTRACT

Disclosed is a jogger exerciser which can be folded to a collapsed position to occupy a minimum space for convenient storage and transport. The jogger exerciser can be safely and easily operated by all ages to provide whole body exercise in a relaxed manner while enjoy exciting swing movements.

11 Claims, 6 Drawing Sheets

JOGGER EXERCISER

BACKGROUND OF THE INVENTION

Most of the commercially available exercisers for jogging are of resistance-driven type, that is, a user must heavily tread a conveyor of the exerciser on tiptop to drive the same to move. Then, the user has to increase the exerciser's momentum by accelerating the movement of his or her tiptoes and thereby gets his or her legs exercised. Following disadvantages are found in the conventional jogger exercises:

1. The conventional jogger exercisers are usually unfoldable in their structure and therefore occupy considerably large room that adversely affects the convenient storage and transport of the exercisers.
2. To use the resistance-driven jogger exerciser, the user must drive the exerciser to move by heavily treading on tiptoe on the conveyor of the exerciser and must tread the conveyor at an increasing speed to keep the exerciser moving. This is obviously an energy-consuming operation not easily performed by those younger or older users.
3. The conventional jogger exerciser is designed for training the muscles of legs and can not be used to get the whole body exercised.
4. Only the legs are moving when using such conventional jogger exerciser. The movement of treading is monotonous without enjoyment.

SUMMARY OF THE INVENTION

It is therefore a primary object of the present invention to provide a jogger exerciser which may get the user's whole body exercised.

Another object of the present invention is to provide a knockdown type jogger exerciser which is foldable and can be disassembled when necessary to reduce the space it occupies for convenient storage and transport.

A further object of the present invention is to provide a jogger exerciser which can be operated in an alternately swinging manner to provide more enjoyment.

To achieve the above objects, the jogger exerciser of the present invention mainly includes two swing members rotatably associated with two support frames and a hand grip detachably connected to a top portion of the support frames. To use the jogger exerciser, firmly hold the hand grip, stably stand on the two swing members, and then relaxedly stretch the whole body and alternately swing the swing members with feets back and forth.

DETAILED DESCRIPTION OF THE PREFERRED EMBODIMENTS

Figure 1:
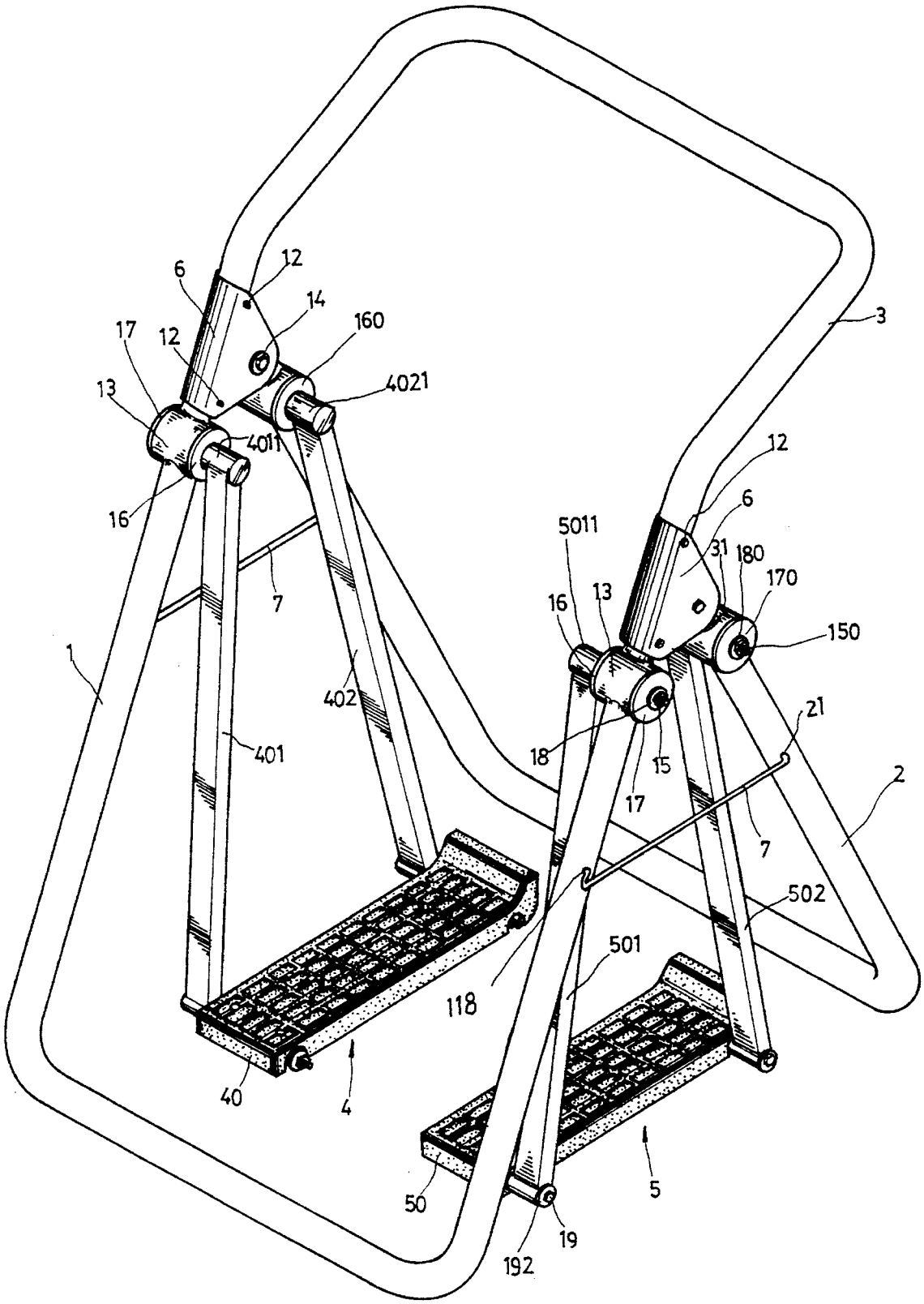
FIG. 1 is an assembled perspective of the jogger exerciser according to the present invention.
Figure 2:
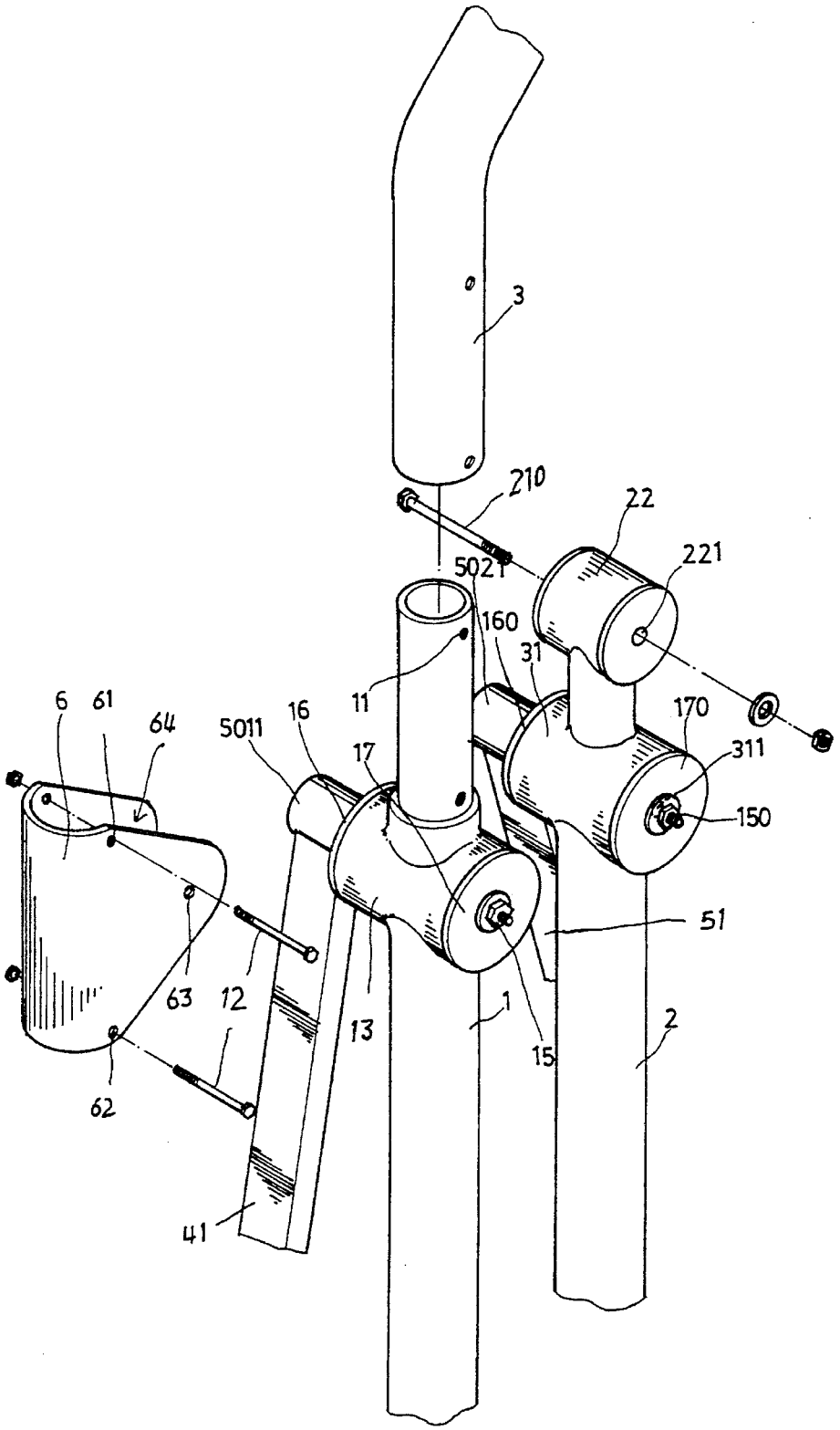
FIG. 2 is a fragmentary, enlarged, disassembled perspective of the jogger exerciser.

Please refer to FIGS. 1 and 2. The present invention relates to a jogger exerciser which mainly includes a first support frame 1, a second support frame 2, a hand grip 3, a first swing member 4, a second swing member 5, and unions 6.

The first support frame 1 is a U-shaped frame formed from a hollow pipe. A transverse lower portion of the first support frame 1 is directly disposed on the ground or the floor as a base. Two upward extended vertical portions of the frame 1 space from each other at a top part at a distance smaller than that at a bottom part thereof. As shown in FIG. 2, each vertical portion of the frame 1 is provided near a top end with a pair of first holes 11 and a pair of second holes 11A below the first holes 11, near a middle outside with a third hole 118, and at a position slightly lower than the top end with a first knuckle member 13 having a first transversely extended central hole 14.

The second support frame 2 is also a U-shaped frame formed from a hollow pipe similar to the first support frame 1. A transverse lower portion of the second support frame 2 is directly disposed on the ground or the floor as a base. Two upward extended vertical portions of the frame 2 space from each other at a top part at a distance smaller than that at a bottom part thereof. As shown in FIG. 2, each vertical portion of the frame 2 is provided at a top end with a connecting head 22 having a third transversely extended central hole 221, at a position slightly lower than the connecting head 22 with a second knuckle member 31 having a second transversely extended central hole 311, and near a middle outside with a fourth hole 21.

The union 6 is a substantially U-shaped member having two substantially triangular side walls parallelly extended from two sides of a rounded middle connecting part to contain a space 64 between them. The space 64 is large enough to fitly clamp the hand grip 3 when the same is connected to the frame 1 and to fitly clamp the connecting head 22 of the frame 2. Three pairs of fifth, sixth, and seventh holes 61, 62, 63 are formed on two side walls of the union 6 at an upper, a lower, and a pointed middle parts thereof, respectively.

Figure 6:
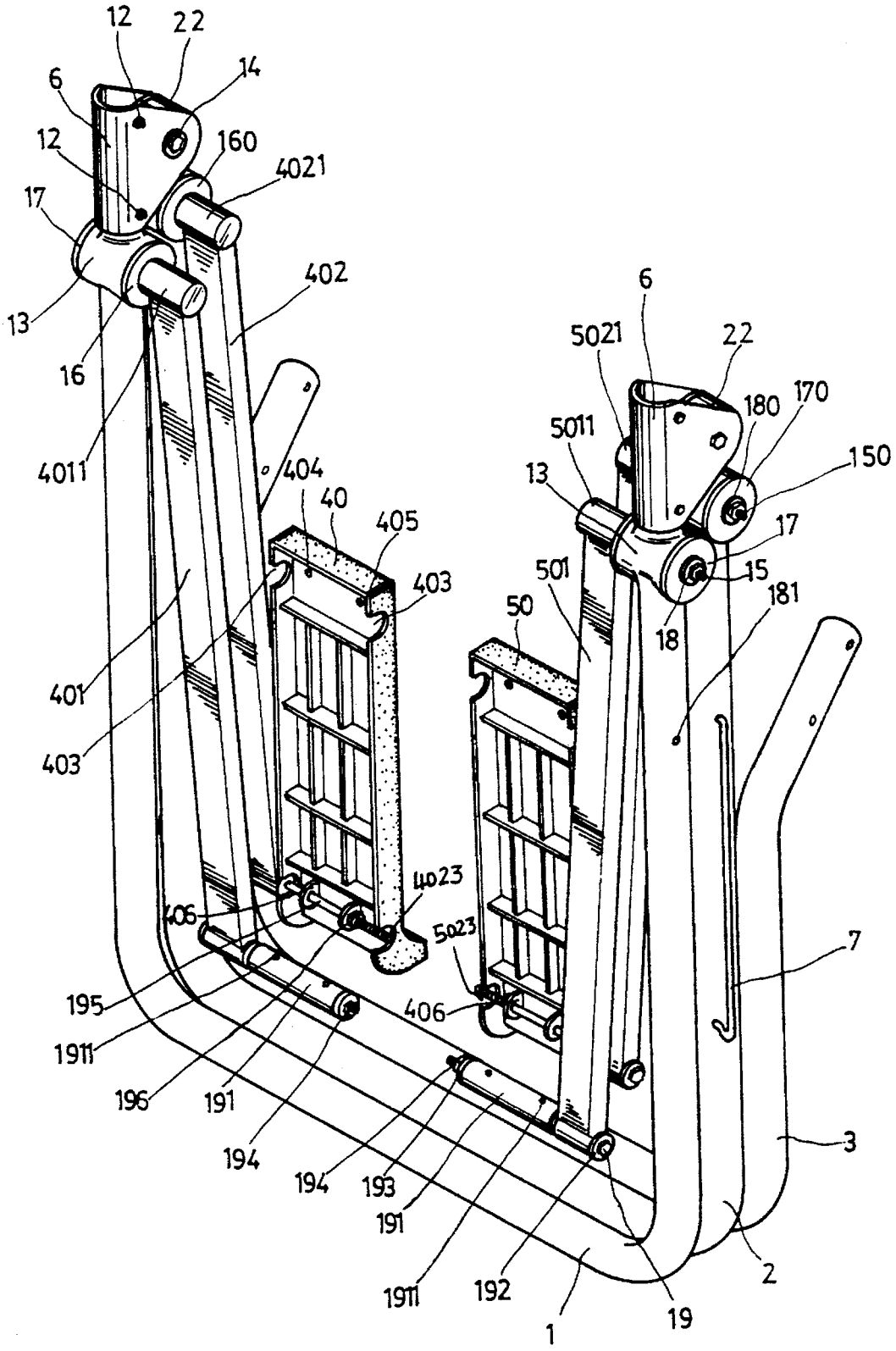
FIG. 6 illustrates the jogger exerciser of the present invention in a folded state.

The first swing member 4 includes a first tread 40, a first link 401 connected to a first end of the first tread 40, and a second link 402 connected to a second end of the first tread 40. The first tread 40 is formed at two longitudinal sides near the first end with a first pair of bottom curved notches 403, at two longitudinal sides near the second end with a second pair of bottom curved notches, at a top surface near the first end just above and between the first pair of notches 403 with an eighth pair of holes 404, 405, and at the top surface near the second end just above and between the second pair of curved notches with a first pair of holding members 406. The first link 401 is formed at a top end with a first inserting stem portion 4011, an outer part of the first inserting stem portion 4011 is formed with a fourth central hole (not shown). As shwon in FIG. 3, the first link 401 is further formed at a bottom end with a first sleeve portion. The second link 402 has a structure similar to that of the first link 401 and is formed at a top end thereof with a second inserting stem portion 4021, an outer part of the second inserting stem portion 4021 is formed with a fifth central hole (not shown). The second link 402 is further formed at a bottom end with a second sleeve portion 4023 (as shown in FIG. 6).

The second swing member 5 is a counterpart of the first swing member 4 and therefore has a second tread 50, a third link 501 connected to a first end of the second tread 50, and a fourth link 502 connected to a second end of the second tread 50. The second tread 50 is formed at two longitudinal sides near the first end with a third pair of bottom curved notches (not shown), at two longitudinal sides near the second end with a fourth pair of bottom curved notches, at a top surface near the first end just above and between the third pair of notches with an pair of eleventh holes (not shown), and at the top surface near the second end just above and between the fourth pair of curved notches with a second pair of holding members 406, as can be seen from FIG. 6. The third link 501 is formed at a top end with a third inserting stem portion 5011, an outer part of the third inserting stem portion 5011 is formed with a sixth central hole (not shown). The third link 501 is further formed at a bottom end with a third sleeve portion (not shown). The fourth link 502 has a structure similar to that of the third link 501 and is formed at a top end thereof with a fourth inserting stem portion 5021, an outer part of the fourth inserting stem portion 5021 is formed with a seventh central hole (not shown). The fourth link 502 is further formed at a bottom end with a fourth sleeve portion 5023 (as shown in FIG. 6).

Two struts 7 are separately extended and interconnected between the third and the fourth holes 118, 21 respectively on the vertical portions of the first and the second frames 1, 2 so as to firmly connect and keep the frames 1, 2 in a widely and stably extended position as shown in FIG. 1.

The hand grip 3 is a reverse U-shaped hollow pipe having a top transverse portion and two downward extended vertical portions. The vertical portions bend slightly at a lower part thereof and each is formed near the lower part with a pair of ninth holes 11B and a pair of tenth holes 11C below the ninth holes 11B. The hand grip 3 has an inner diameter just big enough for the lower part of its vertical portions to mount around an outside diameter of the top part of the vertical portion of the frame 1.

A first screw 12 is used to thread through the respective pairs of fifth, ninth, and first holes 61, 11B, 11, and a second screw 12 is used to thread through the respective pairs of sixth, tenth, and second holes 62, 11C, 11A on the union 6 and each vertical portion of the hand grip 3 and the frame 1, so as to firmly connect the hand grip 3 with the frame 1 with the help of the union 6. A third screw 210 is used to thread through the pair of seventh holes 63 of each union 6 and the third central hole 221 of the connecting head 22 of each vertical portion of the frame 2 clamped in the space 64 between the two side walls of the union 6, so as to indirectly and firmly connect the frame 2 to the frame 1 and the hand grip 3 via the unions 6 to form a stable support stand of the jogger exerciser.

A fourth screw 15 is used to sequentially thread through washers 18, 17, each knuckle 13 on the vertical portions of the frame 1, another washer 16, and into the fourth or the sixth central holes on the first or the third inserting stem 4011 or 5011 of the first link 401 or the third link 501, respectively, to pivotally connect the first and the third links 401, 501 to the first support frame 1.

A fifth screw 150 is used to sequentially thread through washers 180, 170, each knuckle 31 on the vertical portions of the frame 2, another washer 160, and into the fifth or the seventh central holes on the second or the fourth inserting stem 4021 or 5021 of the second link 402 or the fourth link 502, respectively, to pivotally connect the second and the fourth links 402, 502 to the second support frame 2.

Figure 3:
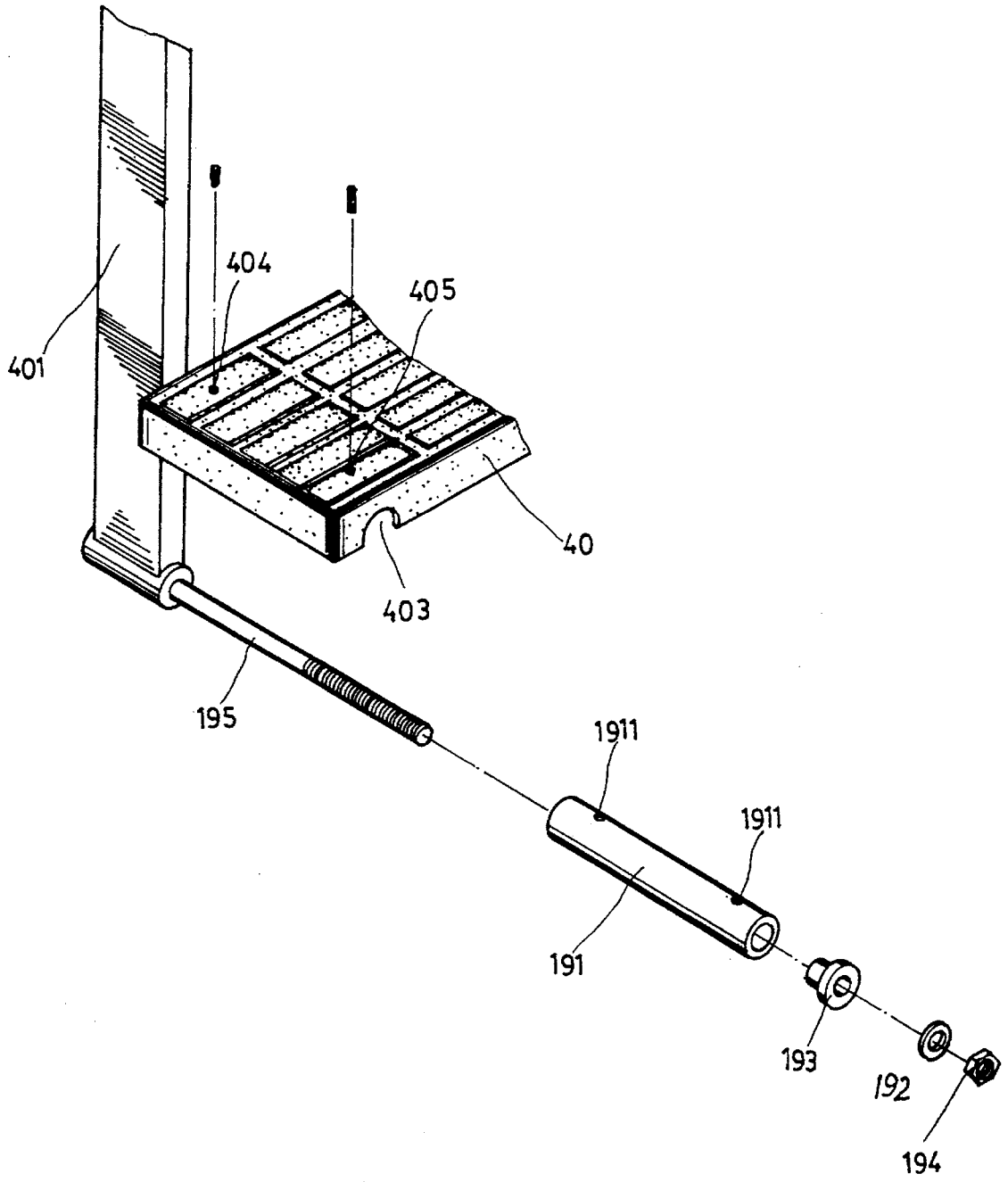
FIG. 3 is a fragmentary, enlarged, disassembled perspective showing the structure of the lower portion of the swing member.

Please refer to FIG. 3. The first sleeve portion 4013 of the first link 401 of the first swing member 4 has a long stem screw 195 connected thereto for a sleeve 191, washers 193, 192 and a first nut 194 to sequentially mount therearound, so as to form a sleeve assembly for extending through the first pair of curved notches 403 beneath the first tread 40. Sixth screws are used to thread through the pair of eighth holes 404, 405 and into two threaded holes 1911 on the sleeve 191 so as to fix the first tread 40 to the first link 401 of the first swing member 4.

Similarly, the third sleeve portion of the third link 501 of the second swing member 5 also has a long stem screw 195 connected thereto for a sleeve 191, washers 193, 192 and a first nut 194 to sequentially mount therearound, so as to form a sleeve assembly for extending through the third pair of curved notches beneath the second tread 50. Sixth screws are used to thread through the pair of eleventh holes on the second tread 50 and into two threaded holes 1911 on the sleeve 191 so as to fix the second tread 50 to the third link 501 of the second swing member 5.

The second sleeve portion 4023 and the fourth sleeve portion 5023 also have a long stem screw 195 connected thereto and a second nut 196 mounted around the long stem screw 195, so that the long stem screws 195 may be threaded into the second and the fourth pairs of notches to engage with the first and the second pairs of holding members 406 and be fixedly lock thereto by means of the second nuts 196, and thereby firmly fix the first and the second treads 40, 50 to the second and the fourth link 402, 502, of the swing members 4, 5, respectively.

Figure 4:
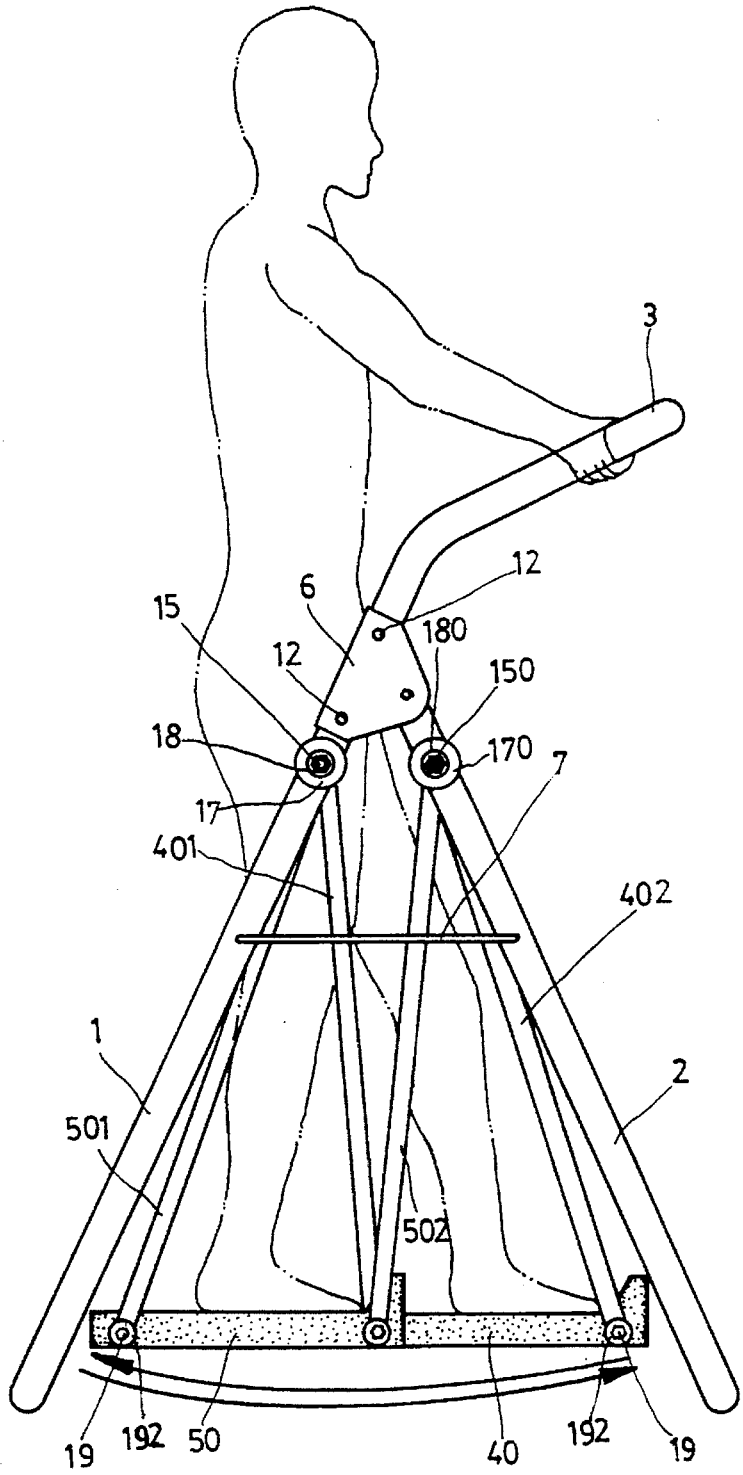
FIG. 4 illustrates the jogger exerciser of the present invention with the swing members in a initial position.
Figure 5:
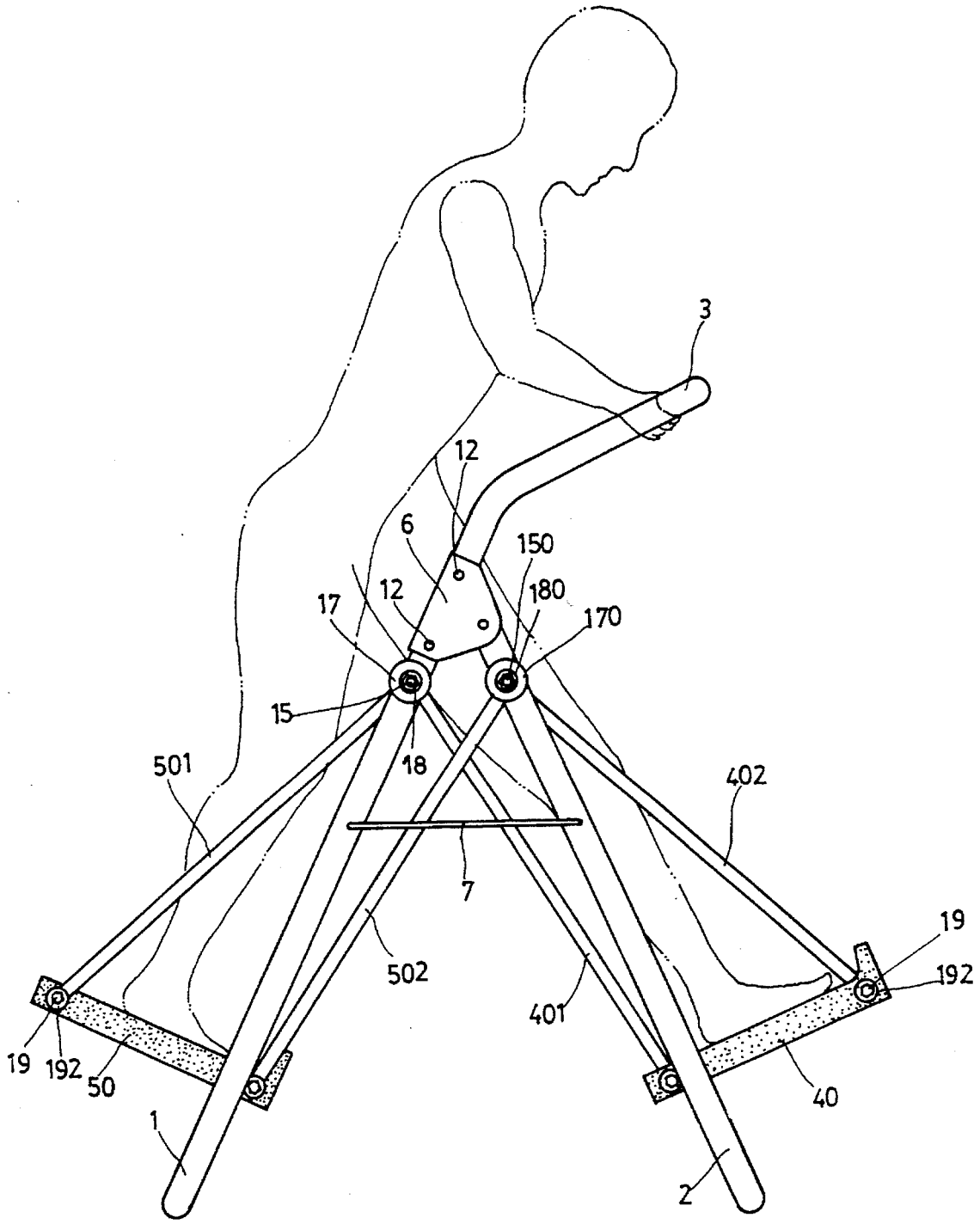
FIG. 5 illustrates the jogger exerciser of the present invention with the swing members in a widely swung position.

To use the jogger exerciser of the present invention, simply stand on the first and the second treads 40, 50 and firmly hold the hand grip 3. Then, exert a minor force to move two feet in different directions so that the first and the second swing members 4, 5 are alternately swung back and forth as shown in FIG. 4. When a heavier force is exerted by the user on the first and the second treads 40, 50, the first and the second swing members 4, 5 shall be swung to a larger span, as shown in FIG. 5, which causes the user to exert force with the whole body. The jogger exerciser of the present invention can be operated in a safe and exciting manner while the whole body of the user can be exercised.

Moreover, the jogger exerciser of the present invention is of a knockdown type and can therefore be disassembled or collapsed or folded at any time to a position as shown in FIG. 6 with reduced volume, occupying less space and to be conveniently stored or transported.

What is claimed is:

1. A jogger exerciser comprising:

a first support frame having a generally U-shape with a transverse lower portion and two upwardly extending vertical portions;

a second support frame having a generally U-shape with a transverse lower portion and two upwardly extending vertical portions;

a hand grip having an inverted U-shape with a transverse top portion and two downwardly extending vertical portions;

first and second swing members each including a tread, a first link and a second link respectively connected to a first and a second end of said tread, and two unions for interconnecting said first support frame, said second support frame, and said hand grip together.

2. A jogger exerciser as claimed in claim 1, further comprising a strut attached between the vertical portions of said first and said second support frames.

3. A jogger exerciser as claimed in claim 1, wherein said upwardly extending vertical portions of said first support frame each have top and bottom parts wherein said top parts are spaced apart a smaller distance than are said bottom parts thereof.

4. A jogger exerciser as claimed in claim 1, further comprising a first knuckle member on said first support frame adjacent to a top end of each of said vertical portions to which said first links of said first and said second swing members are rotatably connected.

5. A jogger exerciser as claimed in claim 1, wherein said union comprises a substantially U-shaped member having two substantially triangular side walls parallelly extending from a rounded middle connecting part to form a space therebetween for attaching top ends of said first and said second support frames and lower ends of said hand grip thereto to firmly connect said lower ends of said hand grip to said top ends of said first support frame, and to top ends of said second support frame.

6. A jogger exerciser as claimed in claim 5, further comprising a connecting head on said vertical portions of said second support frame at a top end said connecting head being mounted in said space between said triangular side walls of said union and affixed thereto thereby connecting said second support frame to said first support frame and said hand grip.

7. A jogger exerciser as claimed in claim 6, further comprising a second knuckle member on said vertical portions of said second support frame at a position lower than said connecting head with a second knuckle member having a second transversely extended central hole, to which said links of said first and said second swing members are rotatably connected.

8. A jogger exerciser as claimed in claim 4, wherein said first links of said first and said second swing members each have a top end with an inserting stem portion, wherein said stem portions are rotatably connected to said first knuckle members on said first support frame.

9. A jogger exerciser as claimed in claim 8, wherein said first links each have a bottom end with sleeve portions received in two pairs of notches formed in a bottom surface of said first end of said treads of said swing members and affixed thereto by means of screws.

10. A jogger exerciser as claimed in claim 8, wherein said second links of said first and said second swing member each have a top end with an inserting stem portion, wherein said stem portions are rotatably connected to said second knuckle members on said second support frame.

11. A jogger exerciser as claimed in claim 10, wherein said second links each have a bottom end with sleeve portions received into two pairs of notches formed at said bottom surface of said treads adjacent said second end thereof to each engage two holding members formed beneath each of said treads and fixedly locked thereto.

* * * * *